US011679429B2

(12) United States Patent
He et al.

(10) Patent No.: US 11,679,429 B2
(45) Date of Patent: Jun. 20, 2023

(54) PROCESSING METHOD OF NPR STEEL REBAR COIL

(71) Applicants: Manchao He, Beijing (CN); Min Xia, Beijing (CN)

(72) Inventors: Manchao He, Beijing (CN); Min Xia, Beijing (CN); Hongyan Guo, Beijing (CN); Hongchao Li, Hebei Province (CN)

(73) Assignees: JING-JIN ELECTRIC TECHNOLOGIES CO., LTD., Beijing (CN); Min Xia, Beijing (CN)

( * ) Notice: Subject to any disclaimer, the term of this patent is extended or adjusted under 35 U.S.C. 154(b) by 0 days.

(21) Appl. No.: 17/640,223

(22) PCT Filed: Sep. 28, 2020

(86) PCT No.: PCT/CN2020/118266
§ 371 (c)(1),
(2) Date: Mar. 3, 2022

(87) PCT Pub. No.: WO2021/047681
PCT Pub. Date: Mar. 18, 2021

(65) Prior Publication Data

US 2022/0314291 A1 Oct. 6, 2022

(30) Foreign Application Priority Data

Sep. 12, 2019 (CN) ..... 201910867335.6

(51) Int. Cl.
*B21C 37/04* (2006.01)
*B21F 45/00* (2006.01)

(52) U.S. Cl.
CPC ..... *B21C 37/045* (2013.01); *B21F 45/006* (2013.01)

(58) Field of Classification Search
CPC ..... B21B 1/163; B21F 45/006; B21C 37/045; B21C 5/006
See application file for complete search history.

(56) References Cited

FOREIGN PATENT DOCUMENTS

CN 1398683 A 2/2003
CN 1686664 A 10/2005
(Continued)

OTHER PUBLICATIONS

"Thirty Thousand Tons Annual Output of Small-diameter Cold-rolled Thread Steel Production Line and Technical and Economic Analysis", Coal Mine Machinery, vol. 31 No. 2, Feb. 2010.
(Continued)

*Primary Examiner* — Edward T Tolan
*Assistant Examiner* — P Derek Pressley
(74) *Attorney, Agent, or Firm* — Fox Rothschild LLP

(57) ABSTRACT

A processing method of NPR steel rebar coil is disclosed. The NPR steel rebar is cold processed and has a diameter of less than 14 mm, and has a yield strength of 800~950 MPa, a tensile strength of 900~1100 MPa, and a elongation of not less than 20%. The processing method comprises: an I-shaped placing step L20, an uncoiling step L30, a flattening step L40, a pointing step L50, a butt welding step L60, a hydraulic head-pushing step L70, a cold drawn smoothing step L80, a grit blasting step L90, an in-situ inline annealing step L10, an air-cooled tempering step L11, a coiling step L12, a placing step L13, a flattening step L14, a cold drawn spiral ribbing step L15, a straightening step L16, and a coiling step L17. The method can achieve full intelligence, meet the processing requirements and the automatic intelligent production requirements of NPR steel rebar coil.

2 Claims, 7 Drawing Sheets

(56) References Cited

FOREIGN PATENT DOCUMENTS

| | | | | |
|---|---|---|---|---|
| CN | 1712179 | A | * | 12/2005 |
| CN | 1712179 | A | | 12/2005 |
| CN | 101386133 | A | * | 3/2009 |
| CN | 101585052 | A | | 11/2009 |
| CN | 103128128 | A | * | 6/2013 |
| CN | 103128128 | A | | 6/2013 |
| CN | 107584048 | A | | 1/2018 |
| CN | 108754305 | A | | 11/2018 |
| CN | 108754339 | A | | 11/2018 |
| CN | 110523801 | A | | 12/2019 |
| JP | H11290915 | A | | 10/1999 |
| JP | 2001079603 | A | * | 3/2001 |
| KR | 101720283 | B1 | | 3/2017 |

OTHER PUBLICATIONS

International Search Report dated Dec. 28, 2020 in PCT/CN2020/118266.
Steel Metallurgy.
Practical Technology for Reinforcement Engineering Construction.

* cited by examiner

PROCESSING METHOD OF NPR STEEL REBAR COIL

CROSS-REFERENCE TO RELATED APPLICATIONS

This application is a § 371 national phase entry of International Patent Application No. PCT/CN2020/118266, filed on Sep. 28, 2020, which claims priority to and the benefit of Chinese Patent Application No. 201910867335.6, filed on Sep. 12, 2019, both of which are hereby incorporated herein by reference in their entireties.

TECHNICAL FIELD

The present disclosure relates to the technical field of steel production, in particular to a processing method of negative Poisson's ratio (NPR) steel rebar coil.

BACKGROUND

As the prior art, the new NPR materials overcome the local deformation and fracture of ordinary rebars and pre-stressed steel rebars, and achieve high strength and high toughness, with a yield strength of up to 900 MPa and a percentage elongation at maximum force of not less than 20%. The automatic intelligent cold rolled (cold drawn) NPR steel rebar coil production line is mainly for cold processing of the new NPR materials, and the products mainly include NPR steel rebars with a diameter of less than 14 mm, cold rolled spiral NPR steel rebars, and pre-stressed NPR steel rebars.

The automatic intelligent production of cold rolled (cold drawn) NPR steel rebar coil includes the following steps: head-to-tail welding, rust removal by steel wire wheel or shot blasting and grit blasting, uncoiling, flattening, pointing or hydraulic pushing head, steel rebar cold drawn trimming, steel rebar straightening, steel rebar tempering, heated steel rebar cooling, tempered steel rebar bundling, steel rebar head pointing, steel rebar flattening, steel rebar finishing welding, steel rebar preliminary straightening, spiral ribbing, steel rebar straightening, steel rebar cutting when two bundling machines are switched, and collecting finished steel rebar.

For the conventional ordinary steel rebar cold processing production line, after pickling and phosphating, paying off by a cannon de-coiler rack or a rotating pay-off reel, traction and wire drawing by a disc-type wire drawing machine, pointing and cold drawing by a wire drawing die, then straightening and cutting off are performed. But it cannot be directly applied to the processing of NPR steel rebar.

The conventional ordinary steel rebar cold processing production line has the following technical drawbacks.

First, the conventional oxide scale removing process using pickling and phosphating cannot meet the national green environmental protection requirements, and cannot achieve inline digital production.

Second, the conventional canon de-coiler rack for coiling and uncoiling can be used for low-carbon, small-diameter steel rebars only, and cannot be used for high-carbon steel rebars or large-diameter high-carbon steel rebars, especially NPR steel rebars that produce resistance due to external forces. The disc-type coil rack cannot be used for the uncoiling of high-strength steel rebars. The above two uncoiling methods cannot achieve continuous production without stopping, and cannot meet the uncoiling requirements of high-strength steel rebars, either.

Third, the conventional steel rebar welding machine can only meet the welding requirements of low-carbon or ordinary high-carbon steel wire; it cannot meet the welding requirements of large diameter, high strength, austenitic steel rebars, cannot realize the automatic burr removal function, and cannot complete the digital operation.

Fourth, the conventional steel rebars are head threaded by pointing or sharpening, resulting in high labor intensity for workers and safety hazards during the operation. The length of rolled head part of steel rebar is too long, and the pointed tip part cannot be used in practical applications and treated as waste, resulting in a great waste of raw materials.

Fifth, in the conventional process, wire drawing dies are used for reducing the diameter and forming. During the processing of high-strength steel wires or austenitic steel rebars, the service life of the wire drawing dies is as short as only 2-3 tons. The cost of the die is extremely high, which accounts for about 60% of its processing cost. The mold needs to be replaced frequently, and the replacement of mold is time-consuming and labor-intensive. Repeated head threading causes a great waste of steel rebar raw materials. Grease lubrication is required, which increases the processing cost of steel rebars.

Lastly, the conventional ordinary steel rebar cold processing production line cannot achieve automated production, remote monitoring, product source tracking of produced rebars, or intelligent storage from raw materials to processing, and cannot achieve intelligent monitoring throughout the entire processing.

In sum, the conventional cold processing production line and processing method of ordinary steel rebar cannot meet the requirements of automatic intelligent production of NPR steel rebar, cold rolled spiral NPR steel rebar, and pre-stressed NPR steel rebar.

SUMMARY

An embodiment of the present disclosure provides a processing method of NPR steel rebar coil to meet the requirements for automatic intelligent production of NPR steel rebar, cold rolled spiral NPR steel rebar, and pre-stressed NPR steel rebar.

In order to achieve the above object, the present disclosure provides a processing method of NPR steel rebar coil, wherein the NPR steel rebar is cold processed and has a diameter of less than 14 mm, the NPR steel rebar has a yield strength of 800~950 MPa, a tensile strength of 900~1100 MPa, and a percentage elongation at maximum force of not less than 20%; the processing method comprises the following steps:

an I-shaped placing step L20: with one end of the steel rebar fixed on a rack, performing head-to-tail welding of the steel rebar at a front end of the steel rebar without stopping;

an uncoiling step L30: providing a drawing force to an I-shaped de-coiler along a travel direction of steel rebar to preliminarily flatten the steel rebar, and synchronizing the I-shaped de-coiler with a wire drawing machine through intelligent control equipment to deliver the steel rebar synchronously for subsequent steps;

a flattening step L40: repeatedly bending the steel rebar to remove a stress in the steel rebar using a wheel-rolling flattening method, so as to flatten the steel rebar without scratches on its surface;

a pointing step L50: correcting or removing surface shape defects of a head part of the steel rebar by a pointing process, during each start of a head threading process in the production line;

a butt welding step L60: matching a diameter of the steel rebar by controlling current using programmable logic controller (PLC) numerical control technology, welding the steel rebar according to time required for steel rebar welding and current for welding, and automatically removing burrs on a surface of the steel rebar after welding is completed;

a hydraulic head-pushing step L70: pushing the head part of the steel rebar to pass through a smooth mold, and setting a length of the head part of the steel rebar passing through the smooth mold according to requirements of the wire drawing machine;

a cold drawn smoothing step L80: performing diameter modification and finishing of NPR steel rebar to make a diameter of a generatrix uniform;

a grit blasting step L90: automatically adjusting output of steel grit according to a diameter and surface requirements of the steel rebar to be processed, and processing oxide scales, surface defects on the surface of hot-rolled NPR steel rebar and lubricating powders of the smooth mold inline, by using intelligent numerical control technology and communicating with a master control equipment; an in-situ inline annealing step L10: performing in-situ inline heating and annealing of the steel rebar;

an air-cooled tempering step L11: cooling high temperature steel rebar inline by air-cooling;

a coiling step L12: high-speed coiling the steel rebar with residual temperature or residual heat, and performing automatic feeding, chucking, automatic head and tail cutting, and automatic unloading;

a placing step L13: uncoiling and placing the steel rebar coil after subjecting to shaping and annealing heat treatment;

a flattening step L14: eliminating an internal stress of the steel rebar using a method of multi-wheel crossed 360-degree curve rolling and straightening;

a cold drawn spiral ribbing step L15: forming spiral ribs on the steel rebar by means of roller die cold rolling;

a straightening step L16: performing fine adjustment based on flattening, using a method of multi-wheel crossed or horizontal straightening; and a coiling step L17: coiling and bundling without stopping inline production.

Further, before the I-shaped placing step L20, the method further comprises:

intelligent master control step L01: connecting an intelligent master control system to a remote computer server through an optical fiber network cable, realizing remote one-key automatic start and stop through the server, and checking running status and production information of production line equipment through the server.

In the processing method of NPR steel rebar coil of the present disclosure, the pickling step in the prior art is replaced by the grit blasting step L90, thereby meeting the national green environmental protection requirements, and realizing digital production inline; the I-shaped placing step L20 and uncoiling step L30 replaces the application of cannon de-coiler rack in the prior art, thereby realizing non-stop production, avoiding surface scratches and bending of steel rebar during the drawing process, and meeting the feeding requirements of high-strength steel rebar; other steps can achieve full intelligence, meet the processing requirements of NPR steel rebar coil, and meet the automatic intelligent production requirements of NPR steel rebar, cold rolled spiral NPR steel rebar, and pre-stressed NPR steel rebar.

DETAILED DESCRIPTION

The present disclosure will be described in further detail below with reference to the drawings and specific embodiments, but they are not intended to limit the present disclosure.

Figure 1:
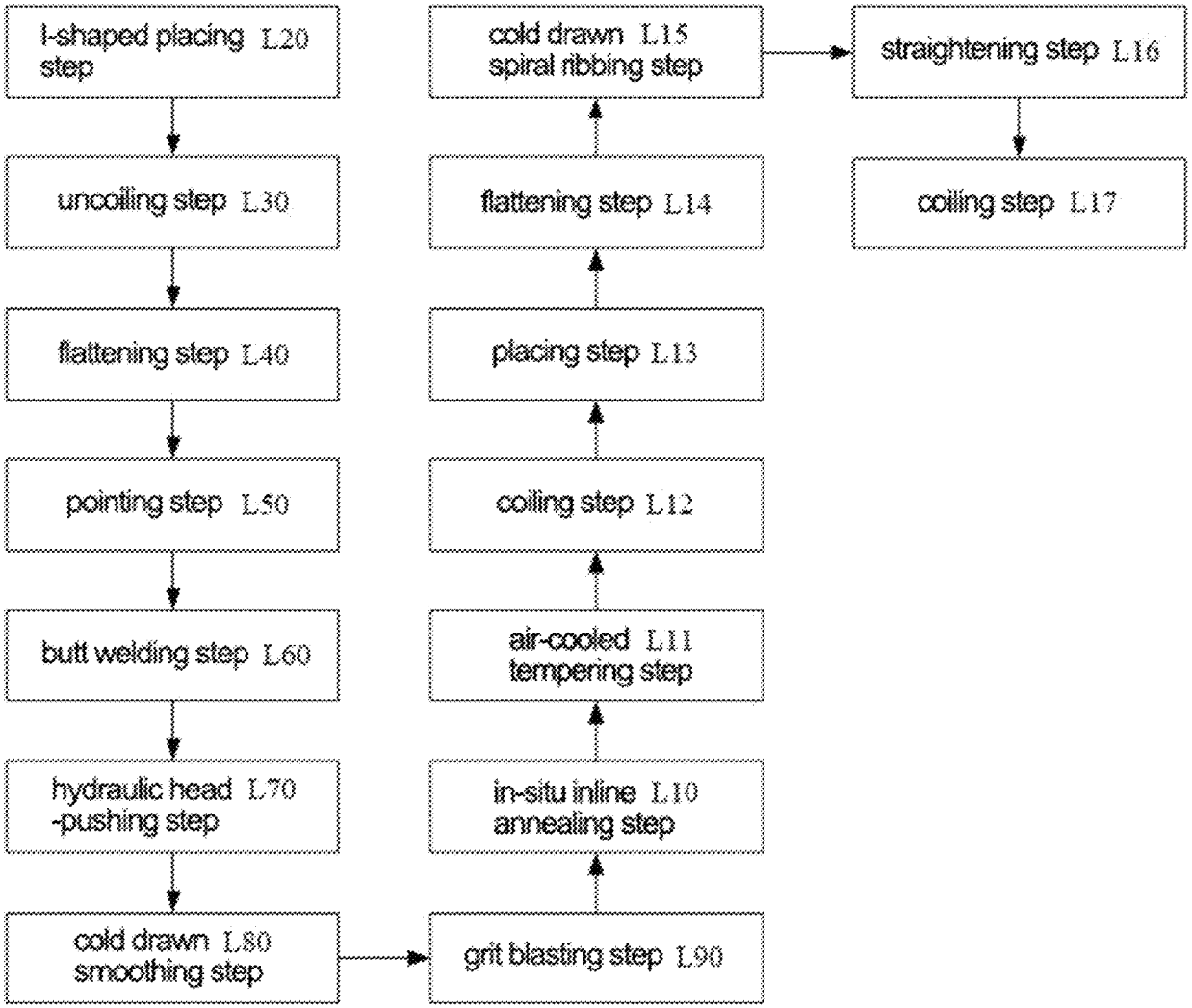
FIG. 1 is a schematic flow chart of a processing method of NPR rebar coil according to an embodiment of the present disclosure.

As shown in FIG. 1, according to an embodiment of the present disclosure, a processing method of NPR rebar coil is provided, in which an automatic intelligent production line of cold rolled (cold drawn) NPR rebar coil is used. The NPR rebar is cold processed, and has a yield strength of 800~950 MPa, a tensile strength of 900~1100 MPa, and a percentage elongation at maximum force of not less than 20%. The processing method comprises the following steps.

Figure 3:
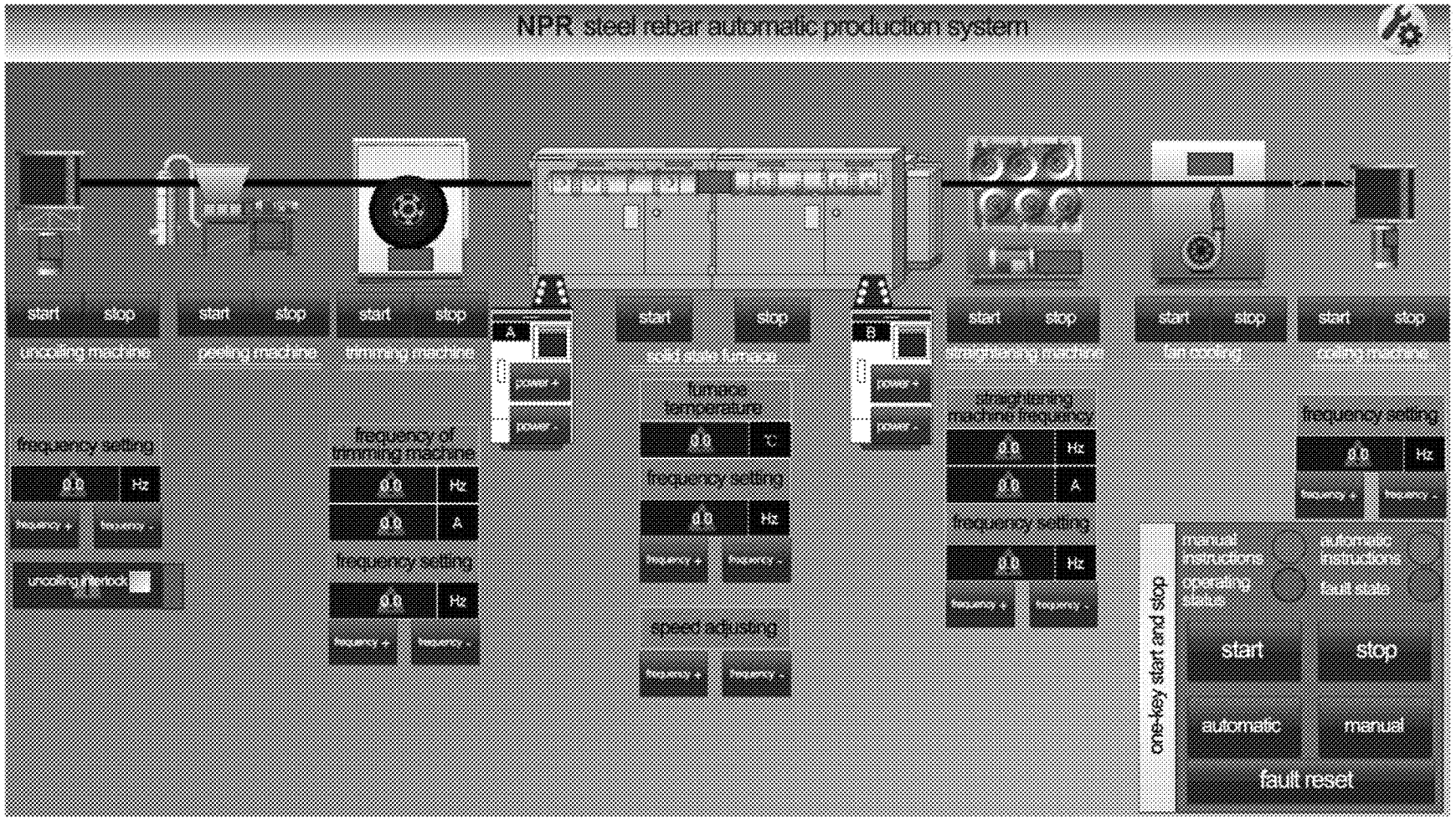
FIG. 3 is a schematic diagram of an interface of the intelligent master control system of the automatic intelligent production line of cold rolled (cold drawn) NPR steel rebar coil.
Figure 4:
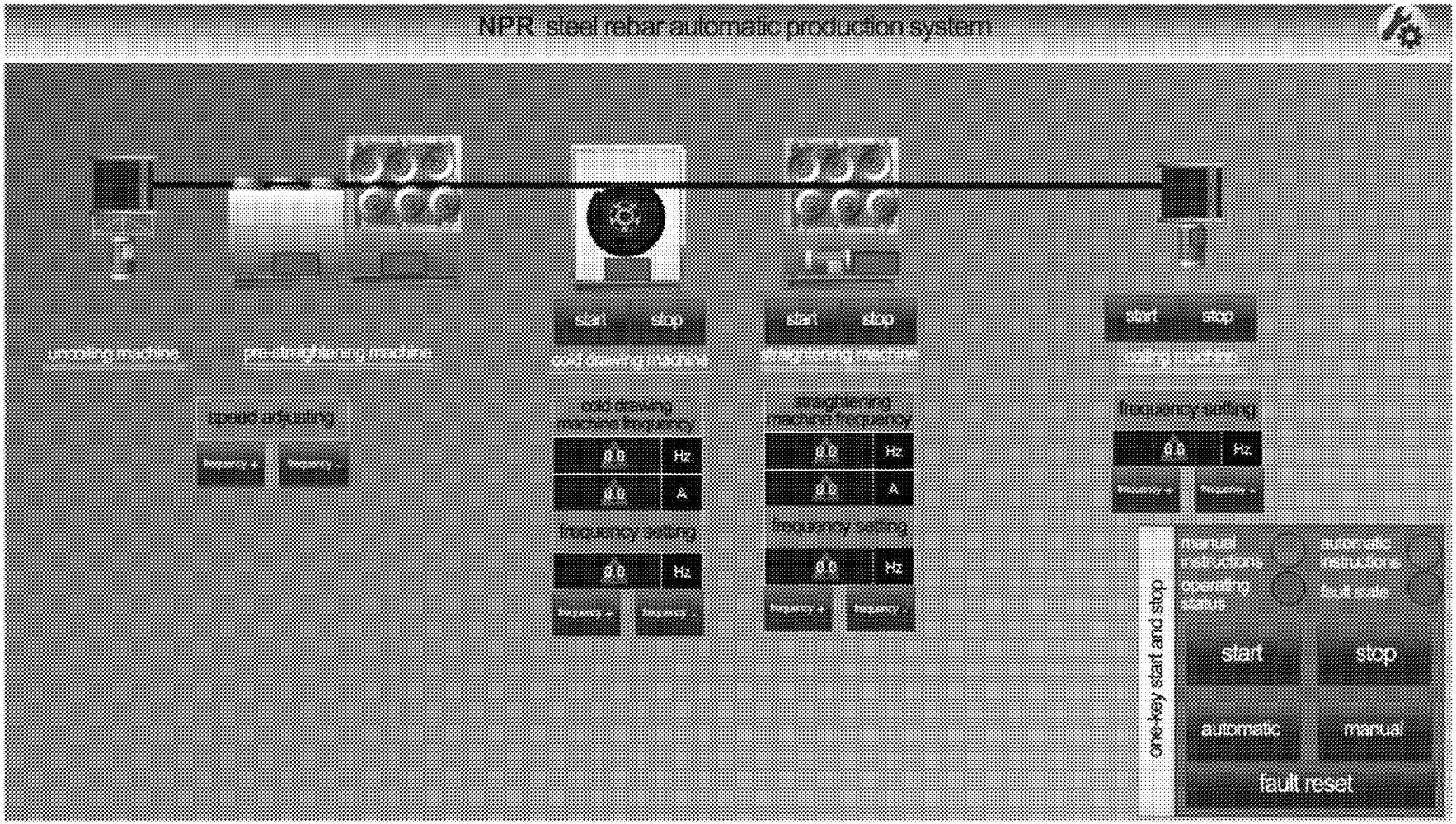
FIG. 4 is a schematic diagram of another interface of the intelligent master control system of the automatic intelligent production line of cold rolled (cold drawn) NPR steel rebar coil.

Intelligent master control step L01: the intelligent master control system is connected to a remote computer server through an optical fiber network cable, and the remote one-key automatic start and stop is realized through the server. The running status and production information of the production line equipment can be checked through the server. The control panel, buttons, PLC modules, power modules, contactors and other necessary electrical devices of each equipment can be used for automatic and manual control operations. The related parameters of the equipment such as equipment name, running status, and steel rebar yield information can be viewed. FIG. 3 and FIG. 4 show the schematic diagrams of the interface of the intelligent master control system of the automatic intelligent production line of cold rolled (cold drawn) NPR steel rebar coil.

Figure 7:
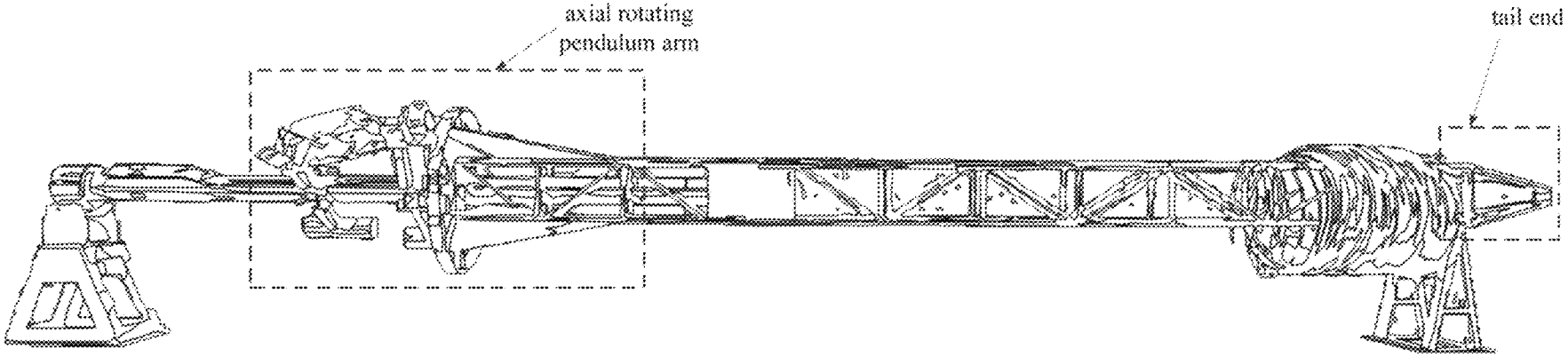
Fig. 7 (prior art)
FIG. 7 is an image of an I-shaped de-coiler.

I-shaped placing step L20: one end of the coil rack is fixed to perform the head-to-tail welding of the steel rebar. The head-to-tail welding of the steel rebar is performed at the front end of the steel rebar without stopping. After expanding and uncoiling, the steel rebar is drawn and unwound into an I-shaped coil rack center. An image of an I-shaped de-coiler used in placing step L20 is shown in FIG. 7. The rotating end of the I-shaped coil rack rotates, so that the steel rebar can be flattened and unwound in the opposite direction of the coiling direction of raw material without generating axial torsion. The tail end of the steel rebar is fixed during the uncoiling process, and the head-to-tail welding can be realized without stopping, so that the normal production of the steel rebar can be realized without stopping.

Uncoiling step L30: a drawing force is provided to the I-shaped de-coiler along the travel direction of steel rebar to preliminarily flatten the steel rebar. The de-coiler is synchronized with the wire drawing machine through intelligent control equipment to deliver the steel rebar synchronously for the subsequent steps. The steel rebar is transported in a straight and flat state and at the same speed to the subsequent devices for flattening, grit blasting and other devices, thereby avoiding the surface scratches and bends of the steel rebar during the drawing process.

Flattening step L40: by the wheel-rolling flattening method, the steel rebar is repeatedly bent to remove the stress in the steel rebar, so as to flatten the steel rebar without scratches on its surface and enter the subsequent devices for grit blasting or wire wheel rust removal in a straight line.

Pointing step L50: the pointing process is used to correct or remove the surface shape defects such as "waterline" or "ellipse" of the head part of the steel rebar during each start of the head threading process in the production line, thereby efficiently solve the problem that the head part of the steel rebar cannot be used during cold rolling.

Butt welding step L60: the current is controlled using PLC numerical control technology to match the diameter of the steel rebar, and the steel rebar is welded according to time required for steel rebar welding and current for welding. After the welding is completed, the burr on the welded surface of the the steel rebar is automatically removed. The welder can weld high-carbon steel wire, low-carbon steel wire, austenitic steel rebar and NPR steel rebar; it can automatically remove the burrs on the welded surface of the steel rebar after welding, and can communicate with the master control equipment network, and can complete the inline welding task or the raw material storage welding task.

Hydraulic head-pushing step L70: the head part of steel rebar is pushed to pass through a smooth mold, and the length of the head part of steel rebar passing through the smooth mold can be set according to the requirements of the wire drawing machine, thereby avoiding the waste of steel rebar caused by sharpening or pointing of the steel rebar when passing the mold, and reducing the labor intensity and time waste of workers. This is a key process to realize automation.

Cold drawn smoothing step L80: the diameter modification and finishing of NPR steel rebar is performed, the base material with irregular diameters is ground, and the diameter of the generatrix becomes uniform after the cold drawn smoothing step.

Grit blasting step L90: by communicating with the master control equipment using intelligent numerical control technology, automatically adjust the output of steel grit according to the diameter and the surface requirements of the steel rebar to be processed, and perform inline processing of the oxide scales, surface defects on the surface of the hot-rolled NPR steel rebar and the lubricating powders of the smooth mold. In order to replace the conventional pickling process, by communicating with the master control equipment using intelligent numerical control technology, automatically adjust the output of steel grit according to the diameter and the surface requirements of the steel rebar to be processed, and perform inline processing of the oxide scale, surface defects on the surface of the hot-rolled NPR steel rebar and the lubricating powder of the smooth mold. The maximum processing speed can reach 80 m/min. After the treatment, the surface is smooth, and the oxide scales, surface defects and the lubricating powders of the smooth mold are removed, thereby avoiding large smoke and dust during inline annealing in the next step. When the output speed of steel grit is too low, or the steel rebar stops moving, or the surface of the steel rebar is not completely processed, an alarm will be automatically produced and transmitted to the central master control equipment, and the process equipment stops.

In-situ inline annealing step L10: the intermediate frequency heating method is used to perform in-situ inline heating and annealing of the steel rebar. During the heating and annealing process, the maximum temperature is 1100 degrees Celsius and the fastest feeding speed is 80 m/s.

Air-cooled tempering step L11: the air-cooling is used to cool the high temperature steel rebar in-line.

Coiling step L12: the NPR steel rebar with residual temperature or residual heat is subjected to high-speed coiling, automatic feeding, chucking, automatic head and tail cutting, and automatic unloading.

Placing step L13: the steel rebar coil after subjecting to shaping and annealing treatment is uncoiled and unwound.

Figure 5:
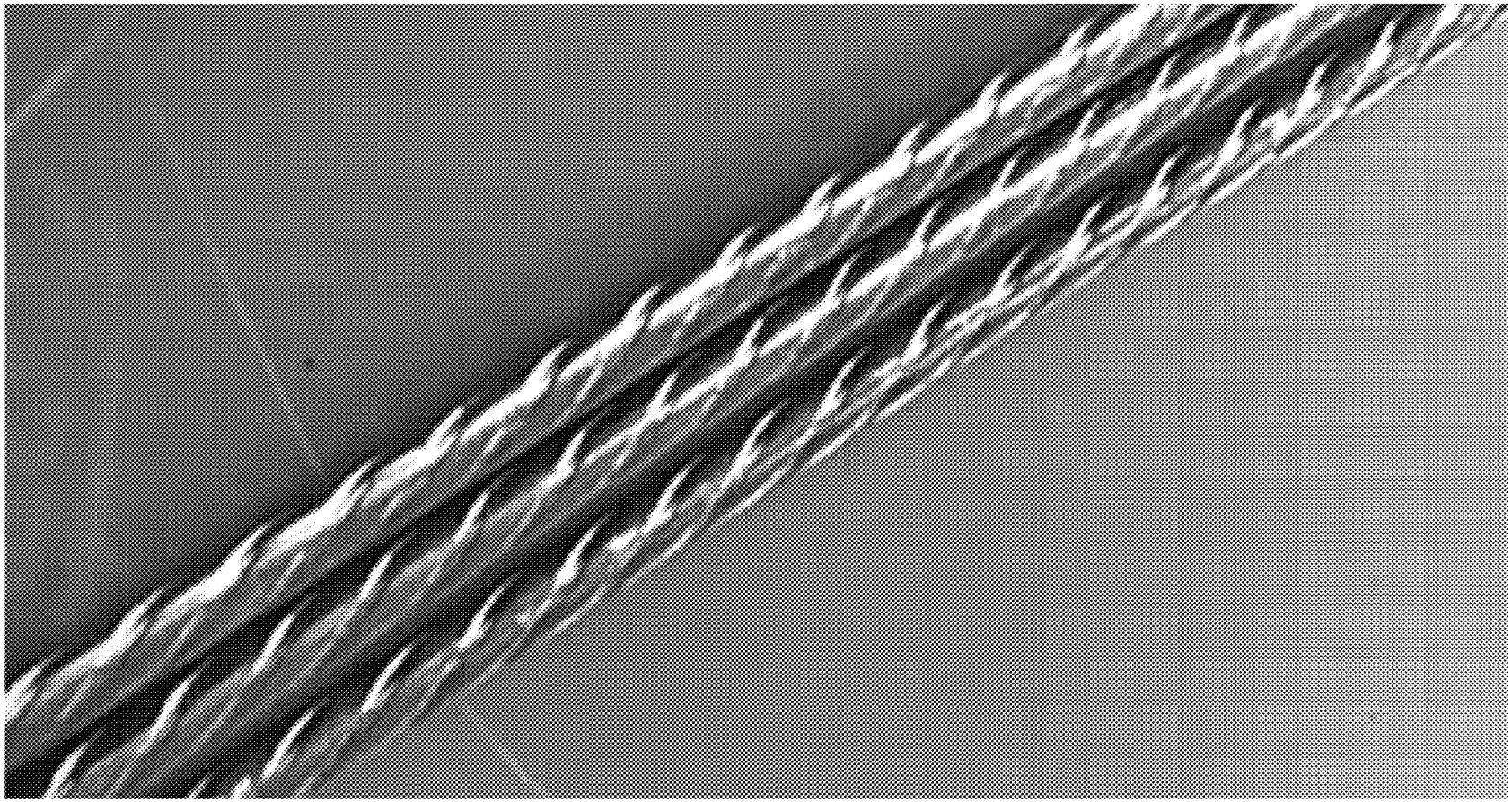
FIG. 5 is a photograph of spiral ribs of the NPR steel rebar obtained by the processing method of NPR steel rebar coil according to an embodiment of the present disclosure.

Flattening step L14: the method of multi-wheel crossed 360-degree curve rolling and straightening is used to eliminate the internal stress of the steel rebar. The spiral ribs of the steel rebar will not be damaged during the pre-straightening process. FIG. 5 shows a photograph of spiral ribs of the NPR steel rebar obtained by the processing method of NPR steel rebar according to an embodiment of the present disclosure.

Cold drawn spiral ribbing step L15: spiral ribs are formed on the steel rebar by means of roller die cold rolling. Specifically, multiple roller dies are uniformly arranged in the circumferential direction in a special rotation device which the base material passes through; when the base material is drawn by the wire drawing machine to pass through the rotation device, the multiple of roller dies produce spiral grooves on the surface of the base material through rolling friction.

Pre-straightening step L16: the method of multi-wheeled crossed or horizontal straightening is used to eliminate the internal stress of the steel rebar. The spiral ribs of the steel rebar will not be damaged during the pre-straightening process. It is connected to the central master control equipment.

Coiling step L17: The equipment in this step consists of a hydraulic shear system, two steel pipes, and two reel-type coiling machines to realize coiling and bundling without stopping.

In the processing method of NPR steel rebar coil of the present disclosure, the pickling step in the prior art is replaced by the grit blasting step L90, thereby meeting the national green environmental protection requirements, and realizing digital production inline; the I-shaped placing step L20 and uncoiling step L30 replaces the application of cannon de-coiler rack in the prior art, thereby realizing non-stop production, avoiding surface scratches and bending of steel rebar during the drawing process, and meeting the feeding requirements of high-strength steel rebar; other steps can achieve full intelligence, meet the processing requirements of NPR steel rebar coil, and meet the automatic intelligent production requirements of NPR steel rebar, cold rolled spiral NPR steel rebar, and pre-stressed NPR steel rebar.

Figure 2:
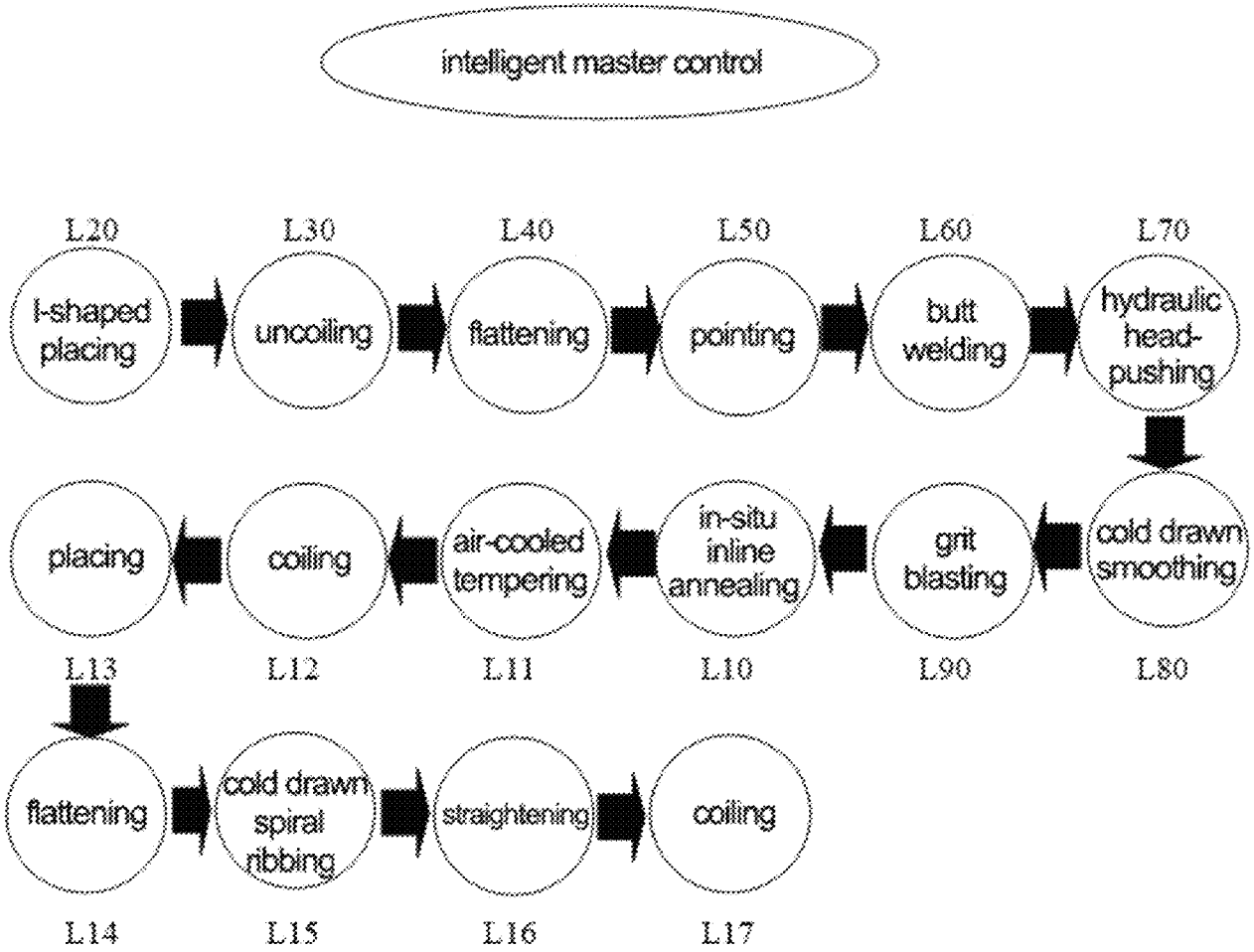
FIG. 2 is a schematic diagram of a specific flow chart of a processing method of NPR rebar coil according to an embodiment of the present disclosure.

Preferably, FIG. 2 shows a specific process. The above cold drawing spiral ribbing step L15 is carried out by a cold drawing spiral ribbing machine, and the production of spiral steel rebar is carried out by means of roller die cold rolling. Specifically, multiple roller dies are uniformly arranged in the circumferential direction in a special rotation device which the base material passes through; when the base material is drawn by the wire drawing machine to pass through the rotation device, the multiple of roller dies produce spiral grooves on the surface of the base material through rolling friction. Compared with the cold drawing method, when the spiral steel rebar is processed by the roller die cold rolling method, the drawing force of the wire drawing machine is halved, the service life of the mold can reach 3000-5000 tons of processed steel rebar, and the extension of the mold life makes it unnecessary to manually replace the mold frequently, which can save more than 90% of the mold cost. Moreover, there is no need to use lubricating grease, powder or oil during the processing, which greatly reduces production costs and labor intensity, and improves production efficiency. Compared with the prior art, it saves more than 20% of manpower, saves more than 60% of electricity, and increases production capacity by more than 20%; each production line can save 3 to 5 million RMB yuans every year.

Figure 6:
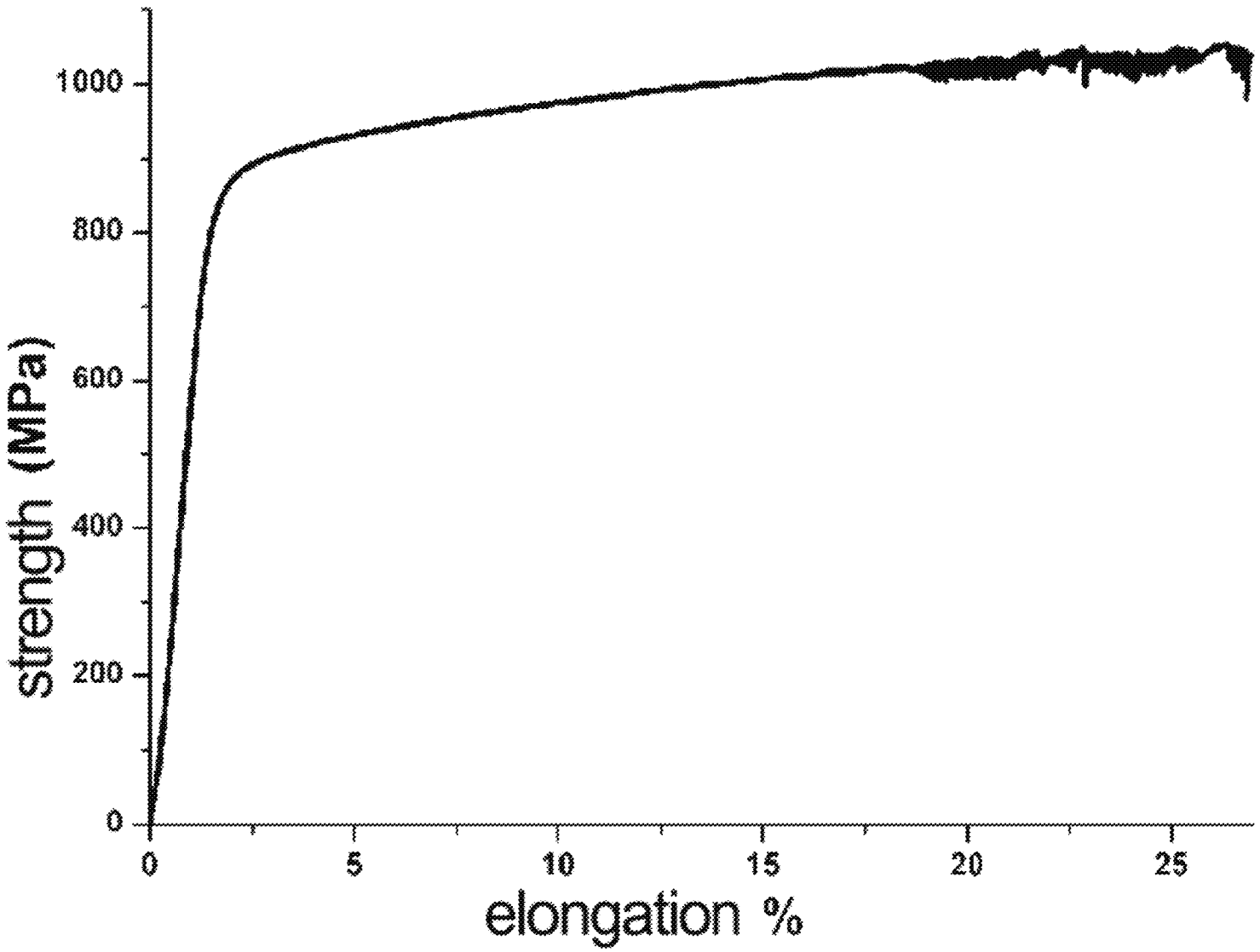
FIG. 6 is a schematic diagram of a tensile test curve of the NPR steel rebar obtained by the processing method of NPR steel rebar coil according to an embodiment of the present disclosure.

Referring to FIG. 5 and FIG. 6, the above automatic intelligent processing method of cold rolled (cold drawn) NPR steel rebar coil has the advantages of low pollution, low energy consumption, intelligence, and high degree of automation, as well as stable quality control and low production costs. In particular, it solves a series of problems that exist in the conventional cold processing of steel rebars, such as environmental protection, low automation, large mold loss, high energy consumption, and the inability to directly process NPR steel rebars. After processed by the automatic intelligent production line of cold rolled (cold drawn) NPR steel rebar coil, the raw material of NPR steel rebar can realize high strength and high toughness, with a yield strength of up to 900 MPa and a percentage elongation at maximum force of not less than 20%.

It should be noted that the terminology used herein is only for describing specific embodiments and is not intended to limit the exemplary embodiments according to the present disclosure. As used herein, the singular forms are intended to include the plural forms as well, unless the context clearly indicates otherwise. It should also be understood that when the terms "include" and/or "comprise" are used in this specification, they indicate there are features, steps, operations, devices, components, and/or combinations thereof.

It should be noted that the terms "first" and "second" in the specification, claims and drawings of the present disclosure are used to distinguish similar objects, and are not necessarily used to describe a specific order or sequence. It should be understood that the terms used in this way are interchangeable under appropriate circumstances so that the embodiments of the present disclosure described herein can be implemented in an order other than those illustrated or described herein.

Of course, the above are only preferable embodiments of the present disclosure. It should be noted that those skilled in the art can make improvements and modifications without departing from the basic principles of the present disclosure, and these improvements and modifications shall also fall within the protection scope of the present disclosure.

What is claimed is:

1. A processing method of negative Poisson's ratio (NPR) steel rebar coil, wherein the NPR steel rebar is cold processed and has a diameter of less than 14 mm, the NPR steel rebar has a yield strength of 800~950 MPa, a tensile strength of 900~1100 MPa, and a percentage elongation at maximum force of not less than 20%; the processing method comprises the following steps:

a placing step L20: fixing one end of a rebar rack on an I-shaped de-coiler, and performing head-to-tail welding of the steel rebar at a front end of the steel rebar without stopping;

an uncoiling step L30: providing a drawing force to the I-shaped de-coiler along a travel direction of steel rebar to preliminarily flatten the steel rebar, and synchronizing the I-shaped de- coiler with a wire drawing machine through intelligent control equipment to deliver the steel rebar synchronously for subsequent steps;

a flattening step L40: repeatedly bending the steel rebar to remove a stress in the steel rebar by a wheel-rolling flattening method, so as to flatten the steel rebar without scratches on its surface;

a pointing step L50: correcting or removing surface shape defects of a head part of the steel rebar by a pointing process, during each start of a head threading process in the production line;

a butt welding step L60: matching a diameter of the steel rebar by controlling current using programmable logic controller (PLC) numerical control technology, welding the steel rebar according to time required for steel rebar welding and current for welding, and automatically removing burrs on a surface of the steel rebar after welding is completed;

a hydraulic head-pushing step L70: pushing the head part of the steel rebar to pass through a smooth mold, and setting a length of the head part of the steel rebar passing through the smooth mold according to requirements of the wire drawing machine;

a cold drawn smoothing step L80: performing diameter modification and finishing of NPR steel rebar to make a diameter of a generatrix uniform;

a grit blasting step L90: automatically adjusting output of steel grit according to a diameter and surface requirements of the steel rebar to be processed, and processing oxide scales, surface defects on the surface of hot-rolled NPR steel rebar and lubricating powders of the smooth mold inline, by using intelligent numerical control technology and communicating with a master control equipment;

an in-situ inline annealing step L10: performing in-situ inline heating and annealing of the steel rebar;

an air-cooled tempering step L11: cooling high temperature steel rebar inline by air- cooling;

a coiling step L12: high-speed coiling the steel rebar with residual temperature or residual heat, and performing automatic feeding, chucking, automatic head and tail cutting, and automatic unloading;

a placing step L13: uncoiling and placing the steel rebar coil after subjecting to shaping and annealing heat treatment;

a flattening step L14: eliminating an internal stress of the steel rebar using a method of multi-wheel crossed 360-degree curve rolling and straightening;

a cold drawn spiral ribbing step L15: using the wire drawing machine to cold draw the steel rebar through roller dies uniformly and circumferentially arranged about the steel rebar in a rotation device forming spiral ribs on the surface of the steel rebar by rolling friction;

a straightening step L16: performing fine adjustment based on flattening, using a method of multi-wheel crossed or horizontal straightening; and a coiling step L17: coiling and bundling without stopping inline production.

2. The processing method according to claim 1, wherein before the placing step L20, the method further comprises:

intelligent master control step L01: connecting an intelligent master control system to a remote computer server through an optical fiber network cable, realizing remote one-key automatic start and stop through the server, and checking running status and production information of production line equipment through the server.

* * * * *